US007126538B2

(12) United States Patent
Sampo

(10) Patent No.: US 7,126,538 B2
(45) Date of Patent: Oct. 24, 2006

(54) MICROSTRIP ANTENNA

(75) Inventor: Takeshi Sampo, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/952,437

(22) Filed: Sep. 29, 2004

(65) Prior Publication Data

US 2005/0146469 A1 Jul. 7, 2005

(30) Foreign Application Priority Data

Sep. 29, 2003 (JP) ..... P2003-338498

(51) Int. Cl.
*H01Q 1/38* (2006.01)
*H01Q 9/30* (2006.01)

(52) U.S. Cl. ..... 343/700 MS; 343/900

(58) Field of Classification Search ..... 343/700 MS, 343/846, 900

See application file for complete search history.

(56) References Cited

U.S. PATENT DOCUMENTS 4,771,291 A * 9/1988 Lo et al. ..... 343/700 MS
5,300,936 A * 4/1994 Izadian ..... 343/700 MS
6,160,512 A * 12/2000 Desclos et al. ..... 343/700 MS
6,329,954 B1 * 12/2001 Fuchs et al. ..... 343/725
6,801,167 B1 * 10/2004 Shibata ..... 343/700 MS

FOREIGN PATENT DOCUMENTS

JP 2002-314323 10/2002

OTHER PUBLICATIONS

Dr. R. B. Waterhouse, "Microstrip Patch Antennas: A Designer's Guide," pp. 7-9 and 43-44, 2003.

* cited by examiner

*Primary Examiner*—Shih-Chao Chen
(74) *Attorney, Agent, or Firm*—Morgan, Lewis & Bockius LLP

(57) ABSTRACT

In a microstrip antenna, a dielectric member is disposed on a grounded conductive plate. A patch antenna element is disposed on the dielectric member. Each of a plurality of conductive rods has an electrical length corresponding to one quarter of a wavelength at a resonance frequency of the microstrip antenna. The rods are arranged on an edge portion of a face of the conductive plate facing the patch antenna element, with an interval which is an electric length corresponding to a half or less of the wavelength at the resonance frequency, such that each of the rods extends perpendicularly to the conductive plate while one end thereof is electrically connected to the conductive plate.

4 Claims, 6 Drawing Sheets

MICROSTRIP ANTENNA

BACKGROUND OF THE INVENTION

The present invention relates to a microstrip antenna having a planar patch antenna element.

An example of a related-art microstrip antenna will be described referring to FIGS. 4A to 5.

As shown in FIGS. 4A and 4B, a dielectric substrate 12 is placed on an upper face of a ground 10 formed of conductive metal, and a planar patch antenna element 14 is placed on an upper face of this dielectric substrate 12. Passing through the ground 10 and the dielectric substrate 12, a core conductor of a feeding cable 16 is electrically connected to the patch antenna element 14. A feeding point 18 of the patch antenna element 14 is at a position offset from a center of the patch antenna element 14.

For the directivity of the microstrip antenna having the above described structure, a high gain can be obtained in an upward direction, and a half power width can be narrowed, as shown in FIG. 5.

In a case where the above described microstrip antenna is arranged, in an electrically spaced manner, on a metallic conductor having a larger area than the ground 10, the directivity largely changes. An example of such an arrangement will be described referring to FIGS. 6A to 7.

As shown in FIGS. 6A and 6B, in a case where a metallic conductor 20 having a large area has been provided below the microstrip antenna, in an electrically spaced manner from the ground 10, the ground 10 and the metallic conductor 20 will be electrically coupled to each other, and a directivity having a decreased gain in an upward direction and a large half power width will be observed, as shown in FIG. 7. According to experiments, in a case where a distance g between the ground 10 and the metallic conductor 20 has an electric length of 1/10 to 11/12 of resonant frequency λ of the microstrip antenna, the half power width is largest, and in a case where the distance g is larger than 1/8 of the resonant frequency λ, almost no influence of the coupling appears. It is apparent that in a case where the distance g is zero, and the ground 10 and the metallic conductor 20 are electrically connected to each other, the metallic conductor 20 acts as the ground 10 having a large area, and the directivity is directed upwardly.

Moreover, the directivity is influenced not only by the metallic conductor 20 having such a shape as expanding around the entirety of the ground 10, as shown in FIGS. 6A and 6B. Japanese Patent Publication No. 2002-314323A discloses that the directivity is influenced, also in a case where the metallic conductor 20 has a rectangular shape of which short sides are shorter than the size of the ground 10, and long sides are longer than the size of the ground 10.

The microstrip antenna is employed, for example, as a GPS antenna and an antenna for ITS (Intelligent Transport System). In a case where this microstrip antenna is mounted on a vehicle, the microstrip antenna is usually arranged on a roof of a vehicle body or a dashboard made of metal plates. Consequently, the roof or the dashboard will act as the metallic conductor 20, and the directivity of the microstrip antenna is influenced. Under the circumstances, there is such an anxiety that a desired directivity cannot be obtained, depending on a manner of arrangement.

SUMMARY OF THE INVENTION

It is therefore an object of the invention to provide a microstrip antenna which is free from an influence of a metallic conductor and can obtain a stable directivity.

In order to achieve the above object, according to the invention, there is provided a microstrip antenna, comprising:

a grounded conductive plate;

a dielectric member disposed on the conductive plate;

a patch antenna element, disposed on the dielectric member; and a plurality of conductive rods, each of which has an electrical length corresponding to one quarter of a wavelength at a resonance frequency of the microstrip antenna, the rods being arranged on an edge portion of a face of the conductive plate facing the patch antenna element, with an interval which is an electric length corresponding to a half or less of the wavelength at the resonance frequency, such that each of the rods extends perpendicularly to the conductive plate while one end thereof is electrically connected to the conductive plate.

With this configuration, standing waves of the resonant frequency is generated in the conductive rods, and an electric voltage becomes null at one end of each rod which is electrically connected to the conductive plate. An electric voltage at the edge of the ground is lowered accordingly, and coupling of the conductive plate to a metallic conductor in the surroundings is decreased. In addition, because the distance between the respective rods is set to have the electric length less than λ/2, electromagnetic waves of the resonant frequency cannot pass through spaces between the rods but interrupted there, and the coupling of the conductive plate to the surrounding metallic conductor by these electromagnetic waves is also decreased. As a result, a desired directivity can be obtained.

Preferably, the conductive plate is a rectangular plate, and the rods are disposed at four corners of the rectangular plate.

Although high voltage tends to be generated at four corners of a rectangular conductive plate, with the above configuration, such voltage is reduced by the standing waves of the resonant frequency generated in the rods, thereby decreasing the coupling of the conductive plate to the surrounding metallic conductor.

Preferably, the interval is constant.

DETAILED DESCRIPTION OF THE INVENTION

Figure 1A:
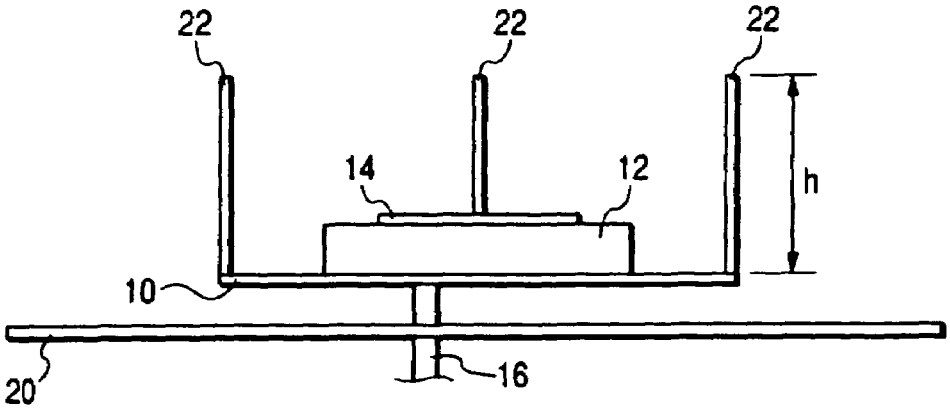
FIG. 1A is a front view of a microstrip antenna according to a first embodiment of the invention.

Referring to the accompanying drawings, the embodiments of the invention will be described below in detail. In these embodiments, similar members to those shown in FIG. 6 will be denoted with the same reference numerals, and repetitive description will be omitted.

Figure 1B:
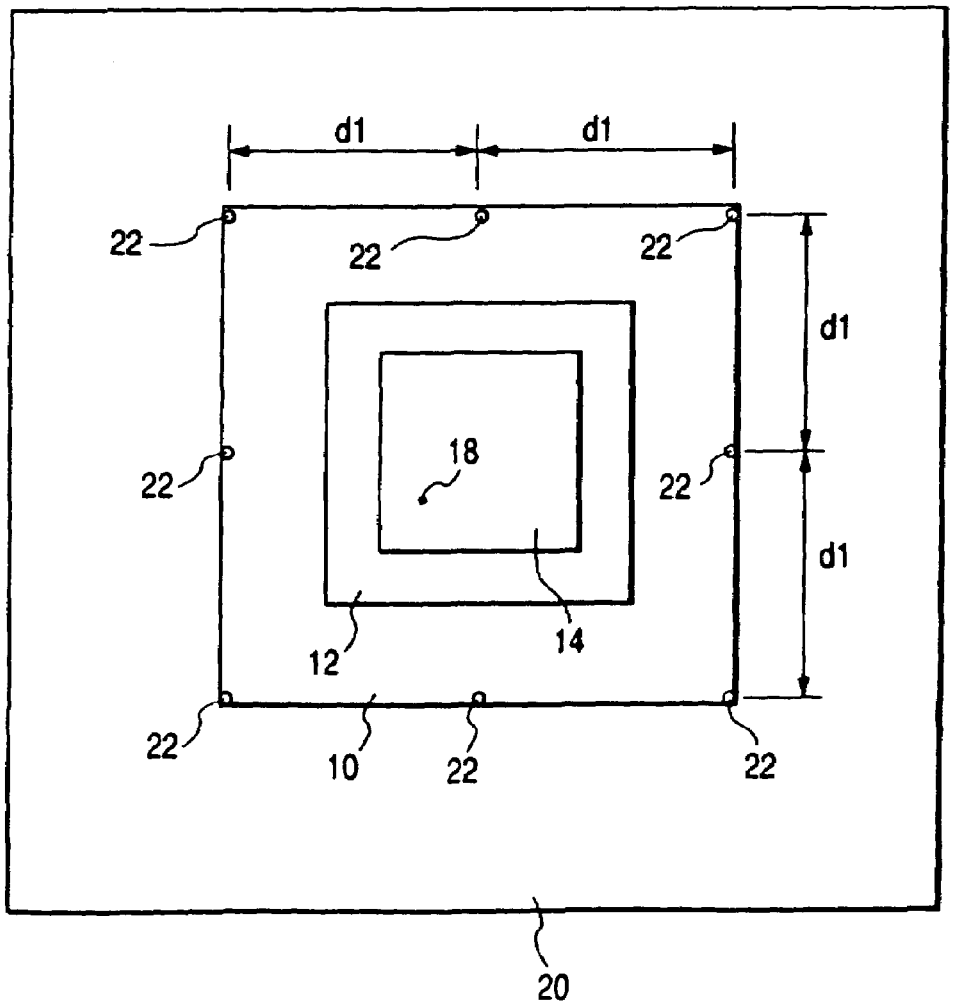
FIG. 1B is a plan view of the microstrip antenna of FIG. 1A.
Figure 6A:
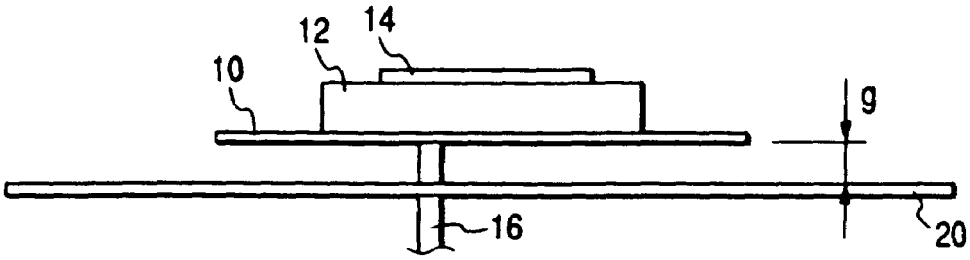
FIG. 6A (Related Art)
FIG. 6A is a front view showing a structure in which the microstrip antenna of FIG. 4A is arranged on a metallic conductor having a large area, in an electrically spaced manner.
Figure 6B:
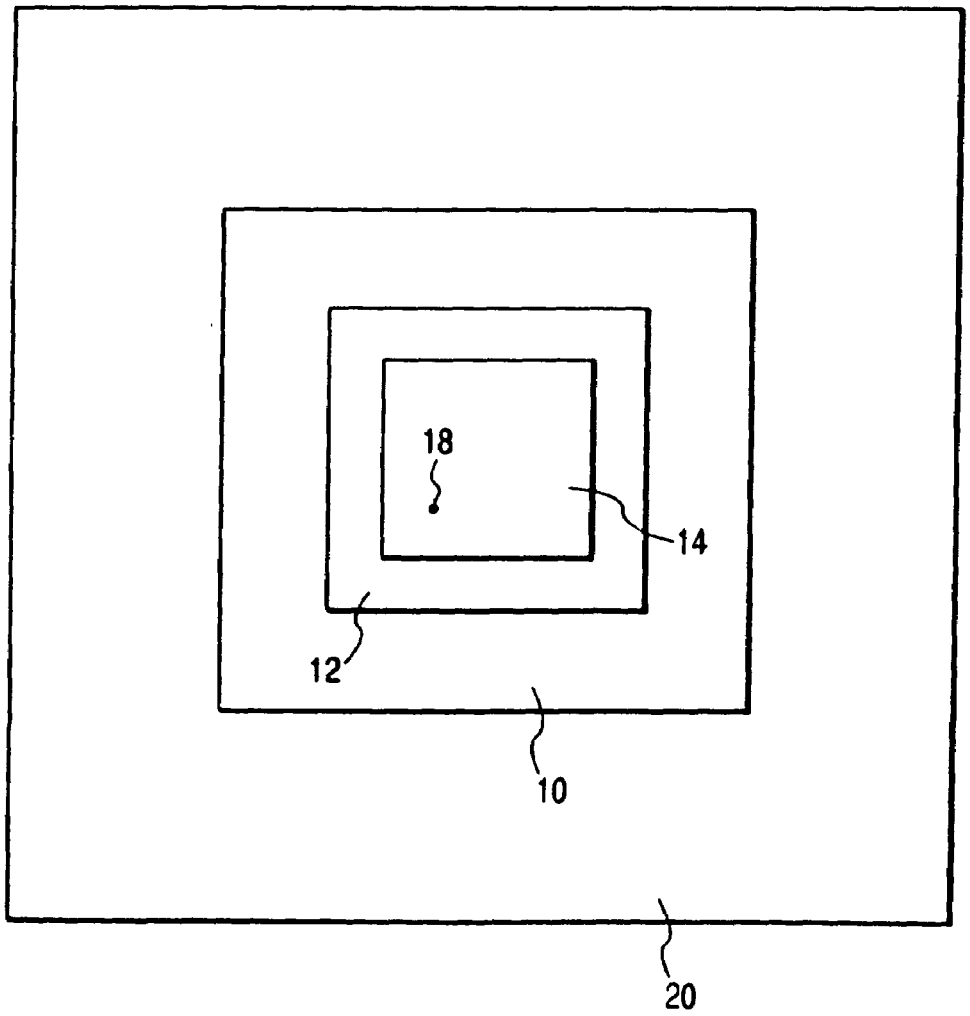
FIG. 6B (Related Art)
FIG. 6B is a plan view showing the structure of FIG. 6A.
Figure 7:
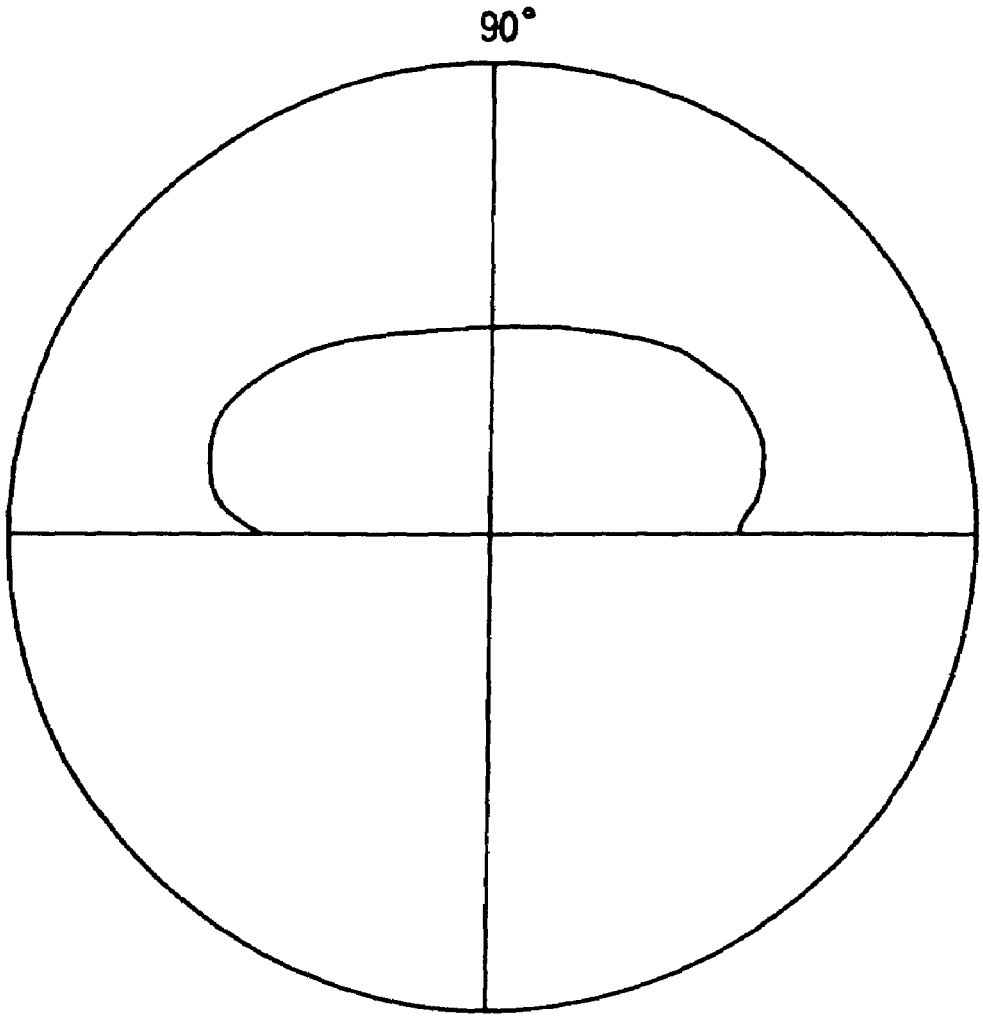
FIG. 7 (Related Art)
FIG. 7 is a directivity diagram of the microstrip antenna of FIG. 6A viewed from the front side thereof.

In the microstrip antenna according to a first embodiment of the invention, as shown in FIG. 1, the microstrip antenna is different from the structure as shown in FIG. 6 in that a plurality of metal rods 22 are uprightly provided on edges of the ground 10 at a side where the patch antenna element 14 is mounted. A base end of each of the metal rods 22 is electrically connected to the ground 10. A height h of the metal rod 22 is set to have an electric length of ¼ of a wavelength λ of resonant frequency of the microstrip antenna. A distance d1 between the respective metal rods 22 is set to have an electric length less than ½ of the wavelength λ. The metal rods 22 must be uprightly provided in the four corners of the ground 10, and in a case where the distance between these metal rods 22 has an electric length longer than λ/2, the metal rod 22 may be additionally provided between them on the edge of the ground 10.

According to this structure, standing waves of the resonant frequency is generated in the metal rod 22 having the electric length of λ/4, and an electric voltage becomes null at the base end of the metal rod 22 which is electrically connected to the ground 10. An electric voltage at the edge of the ground 10 is lowered accordingly, and coupling of the ground 10 to the metallic conductor 20 in the surroundings is remarkably decreased. In the structure as shown in FIG. 6 in which the metal rods are not provided, there is a tendency that the electric voltage in the corners of the ground 10 is particularly enhanced.

Further, because the distance between the respective metal rods 22 is set to have the electric length less than λ/2, electromagnetic waves of the resonant frequency cannot pass through spaces between the metal rods 22 but interrupted there, and the coupling of the ground 10 to the surrounding metallic conductor 20 by these electromagnetic waves is decreased.

Figure 2:
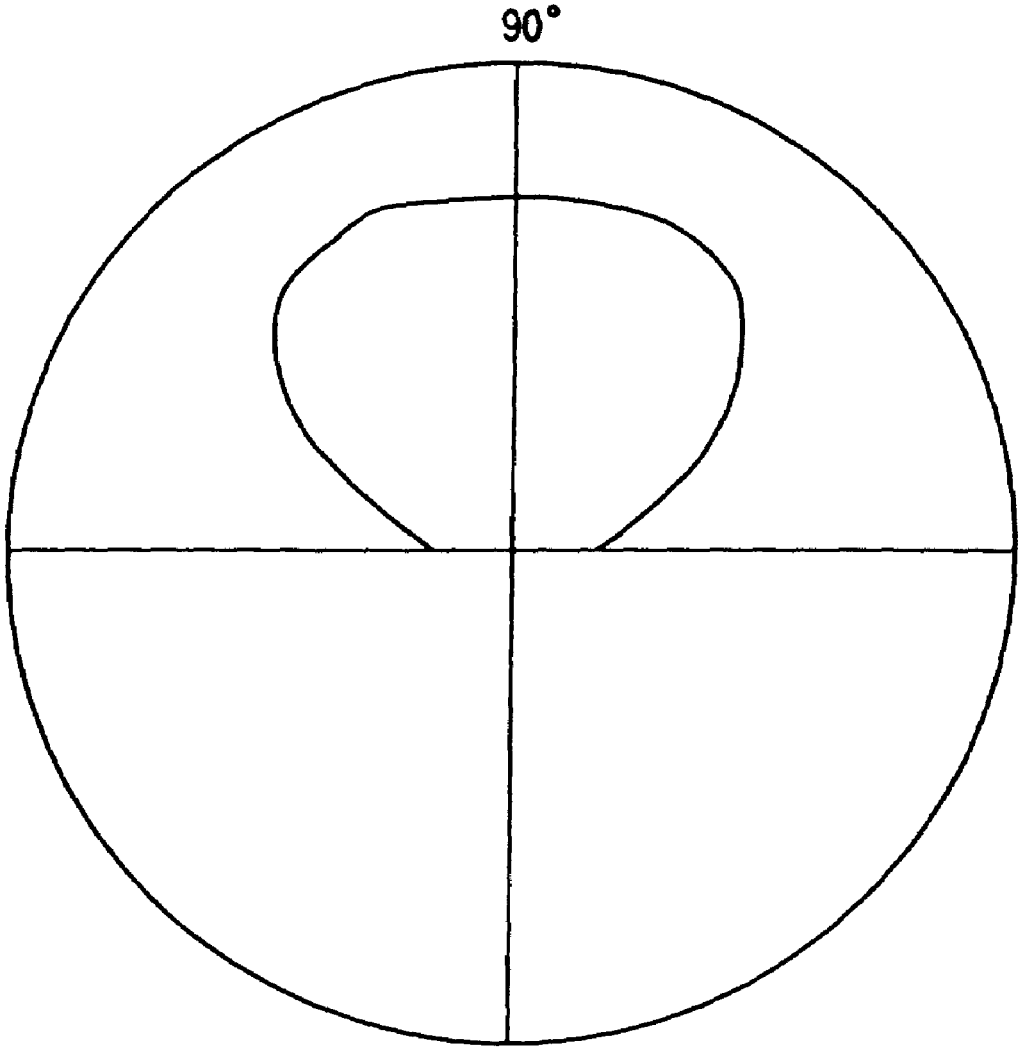
FIG. 2 is a directivity diagram of the microstrip antenna of FIG. 1A viewed from the front side thereof.

As the results, despite that the metallic conductor 20 exists in the surroundings, the directivity is remarkably improved in an upward direction, and also, the half power width becomes small, as shown in FIG. 2. Moreover, it has been experimentally confirmed that the directivity is not largely influenced by the shape of the metallic conductor 20 in the surroundings and so on.

Figure 3A:
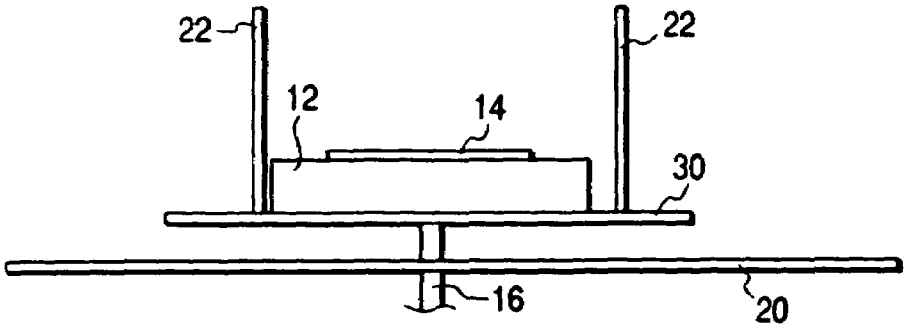
FIG. 3A is a front view of a microstrip antenna according to a second embodiment of the invention.
Figure 3B:
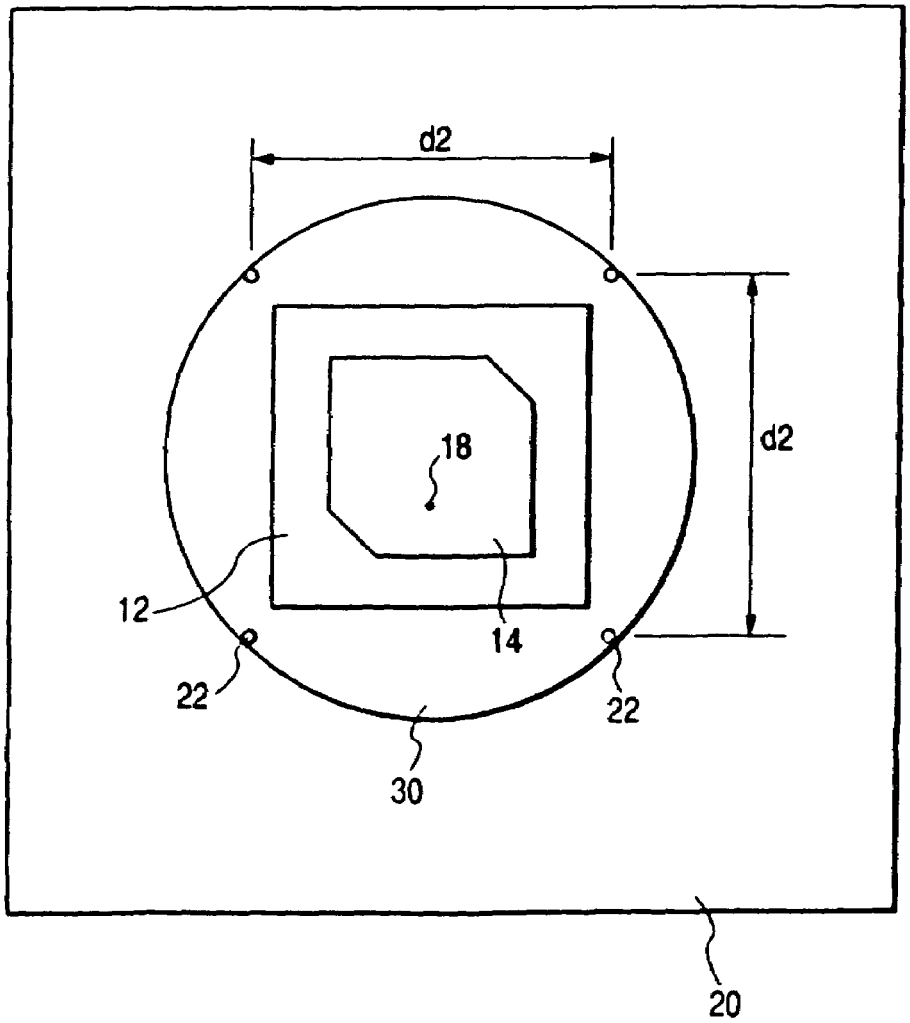
FIG. 3B is a plan view of the microstrip antenna of FIG. 3A.
Figure 4A:
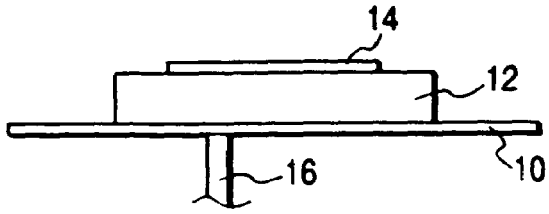
FIG. 4A (Related Art)
FIG. 4A is a front view of a related-art microstrip antenna.
Figure 4B:
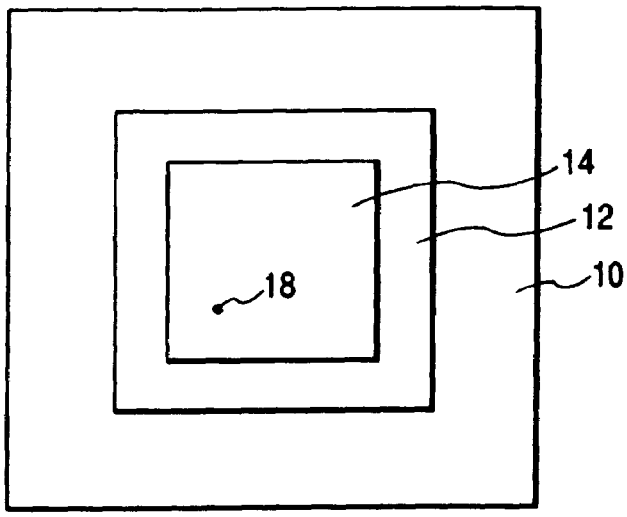
FIG. 4B (Related Art)
FIG. 4B is a plan view of the microstrip antenna of FIG. 4A.
Figure 5:
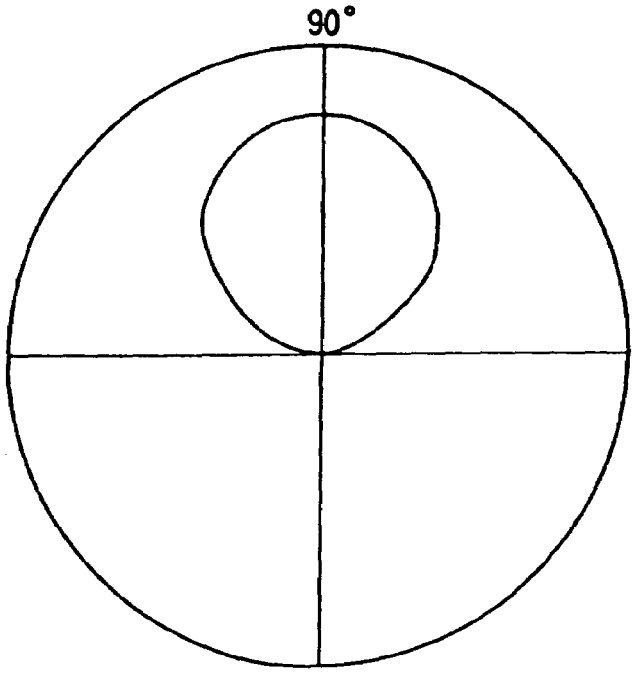
FIG. 5 (Related Art)
FIG. 5 is a directivity diagram of the microstrip antenna of FIG. 4A viewed from the front side thereof.

Next, a second embodiment of the invention will be described referring to FIGS. 3A and 3B. In this embodiment, similar members to those shown in FIG. 1 will be denoted with the same reference numerals, and repetitive description will be omitted.

In this embodiment, a ground 30 has a circular shape in a plan view. The metal rods 22 are equidistantly provided uprightly on an edge of the ground 30 in such a manner that a distance d2 between the respective metal rods 22 may have an electrical length less than λ/2. As the results, in the same manner as with the structure in the first embodiment, the coupling to the metallic conductor 20 in the surroundings is decreased, and the directivity having a high gain in an upward direction can be obtained.

It is easily understood that in the above described embodiments, the height h of the metal rod 22 is not limited to λ/4, but may be an odd multiple of λ/4, for example, 3λ/4 or 5λ/4, provided that the height may be so set as to generate the standing waves of the resonant frequency. Moreover, it is apparent that the patch antenna element 14 is to be appropriately set according to a linear polarization signal or a circular polarization signal to be resonated. Further, instead of the dielectric substrate 12, an air layer may be employed as the dielectric substance. Still further, a substance to be interposed between the ground 10, 30 and the metallic conductor 20 is not limited to an air layer, but an conductive substance may be interposed.

What is claimed is:

1. A microstrip antenna, comprising:

a grounded conductive plate;

a dielectric member disposed on the conductive plate;

a patch antenna element, disposed on the dielectric member; and a plurality of conductive rods, each of which has an electrical length corresponding to one quarter of a wavelength at a resonance frequency of the microstrip antenna, the rods being arranged on an edge portion of a face of the conductive plate facing the patch antenna element, with an interval which is an electric length corresponding to a half or less of the wavelength at the resonance frequency, such that each of the rods extends perpendicularly to the conductive plate while one end thereof is electrically connected to the conductive plate.

2. The microstrip antenna as set forth in claim 1, wherein the conductive plate is a rectangular plate, and the rods are disposed at four corners of the rectangular plate.

3. The microstrip antenna as set forth in claim 1, wherein the interval is constant.

4. The microstrip antenna as set forth in claim 1, wherein the conductive plate has a larger area than an area of the dielectric member.

* * * * *